US010807223B2

(12) United States Patent
Liao

(10) Patent No.: US 10,807,223 B2
(45) Date of Patent: Oct. 20, 2020

(54) QUICK RELEASE DEVICE FOR A PANEL OF NAIL GUNS

(71) Applicant: TESTO INDUSTRY CORP., Taichung (TW)

(72) Inventor: Min-Ho Liao, Taichung (TW)

(73) Assignee: TESTO INDUSTRY CORP., Taichung (TW)

( * ) Notice: Subject to any disclaimer, the term of this patent is extended or adjusted under 35 U.S.C. 154(b) by 121 days.

(21) Appl. No.: 16/231,586

(22) Filed: Dec. 23, 2018

(65) Prior Publication Data

US 2020/0016731 A1 Jan. 16, 2020

(30) Foreign Application Priority Data

Jul. 16, 2018 (TW) ..... 107209557 U

(51) Int. Cl.
*B25C 1/08* (2006.01)
*B25C 1/00* (2006.01)

(52) U.S. Cl.
CPC ..... *B25C 1/008* (2013.01); *B25C 1/001* (2013.01)

(58) Field of Classification Search
CPC ..... B25C 1/001; B25C 1/008
USPC ..... 227/123
See application file for complete search history.

(56) References Cited

U.S. PATENT DOCUMENTS 4,436,236 A * 3/1984 Jobe ..... B25C 5/1665 227/123
6,016,946 A * 1/2000 Phillips ..... B25C 1/08 123/46 SC
6,318,618 B1 * 11/2001 Jen ..... B25C 5/1665 227/123
6,325,268 B1 * 12/2001 Liang ..... B25C 5/1665 227/123
7,175,063 B2 * 2/2007 Osuga ..... B25C 1/008 227/130
7,565,992 B2 * 7/2009 Buetow ..... B25C 7/00 227/110
7,922,054 B2 * 4/2011 Cole, Jr. ..... B25C 1/008 227/8
8,556,148 B2 * 10/2013 Schell ..... B25C 1/005 227/123
8,833,628 B2 * 9/2014 Schwartzenberger .. B25C 1/188 227/109
9,149,920 B2 * 10/2015 Hoshino ..... B25C 1/008
(Continued)

*Primary Examiner* — Andrew M Tecco
*Assistant Examiner* — Eyamindae C Jallow
(74) *Attorney, Agent, or Firm* — Hershkovitz & Associates, PLLC; Abe Hershkovitz

(57) ABSTRACT

A quick release device for a panel of nail guns has a quick release mount, a pulling base, and an elastic element. The quick release mount is disposed on a body of a nail gun adjacent to a rear end of an ejecting track, and has two connecting boards and a pivotal rod connected to the two connecting boards. The pulling base is pressably connected to the quick release mount, selectively engages with a panel of the nail gun, and has an engaging hook, a pivot hole, and a pulling arm. The engaging hook is formed on the pulling base, and selectively engages with a limiting claw of the panel to limit a position of the panel relative to the ejecting track. The elastic element is mounted between the quick release mount and the pulling base to provide a returning force to the pulling base.

8 Claims, 9 Drawing Sheets

(56) References Cited

U.S. PATENT DOCUMENTS

| | | | | |
|---|---|---|---|---|
| 2002/0030079 | A1* | 3/2002 | Adachi | B25C 5/1665 227/123 |
| 2003/0062394 | A1* | 4/2003 | Wang | B25C 5/1665 227/123 |
| 2005/0001007 | A1* | 1/2005 | Butzen | B25C 1/047 227/130 |
| 2005/0145669 | A1* | 7/2005 | Chen | B25C 5/1665 227/123 |
| 2018/0126529 | A1* | 5/2018 | Pomeroy | B25C 1/047 |
| 2018/0126531 | A1* | 5/2018 | Pomeroy | B25C 1/04 |

* cited by examiner

QUICK RELEASE DEVICE FOR A PANEL OF NAIL GUNS

BACKGROUND OF THE INVENTION

1. Field of the Invention

The present invention relates to a quick release device, and more particularly to a quick release device for a panel of nail guns, which may be operated in a labor-saving manner, may be assembled or detached easily, and may avoid damaging workpieces.

2. Description of Related Art

When a conventional nail gun is in use, compressed air flows into the conventional nail gun to push nails in a magazine to eject out of a barrel of the conventional nail gun. However, during the process of ejecting the nails out of the conventional nail gun, the nails may not be successfully ejected but resist inside the conventional nail gun due to the structure of the nails or the flow of the compressed air. With reference to FIG. 8, in order to quickly eliminate the problem that the aforementioned nails cannot be ejected, a panel 72 is disposed detachably on a magazine 71 of another conventional nail gun 70. When the nails cannot be ejected from the magazine 71, a user may exclude the problematic nails via the panel 72. Furthermore, the panel 72 is securely disposed on the conventional nail gun 70 by a quick release device 80.

With further reference to FIG. 9, the quick release device 80 of the conventional nail gun 70 has a pulling frame 81 and a turning frame 82. The pulling frame 81 is pivotally connected to an end of the panel 72 to enable the pulling frame 81 to rotate relative to the panel 72. The pulling frame 81 has a trigger stem 83 disposed opposite to the connection position between the panel 72 and the pulling frame 81. Then, the pulling frame 81 can be rotated relative to the panel 72 by pulling the trigger stem 83 as shown in FIG. 9. The turning frame 82 is connected to the conventional nail gun 70 and the pulling frame 81 between the connection position and the trigger stem 83 to provide a force to the pulling frame 81 for abutting against the panel 72.

Though the user can exclude the problematic nails of the conventional nail gun 70 by the quick release device 80, the turning frame 82 must provide a sufficient force to the pulling frame 81 for abutting against the panel 72 during the process of ejecting the nails to prevent the nails from un-ejecting or ejecting randomly. Consequently, when a user pulls the pulling frame 81 via the trigger stem 83, it may take a considerable amount of force to rotate the pulling frame 81 relative to the panel 72, which is not only extremely laborious and easy to cause the user to be injured due to the collision, but also causes inconvenience in assembly and disassembly. Furthermore, a top surface of the panel 72 is in the shape of an uneven groove, such that when the conventional nail gun 70 abuts against a workpiece, it is easy to damage the workpiece during the process of abutting due to the uneven groove structure of the top surface of the panel 72. Therefore, the quick release device 80 for the panel 72 of the conventional nail gun 70 needs improvement.

To overcome the shortcomings, the present invention tends to provide a trigger for a nail gun to mitigate or obviate the aforementioned problems.

SUMMARY OF THE INVENTION

The main objective of the invention is to provide a quick release device for a panel of nail guns, which may be operated in a labor-saving manner, may be assembled or detached easily, and may avoid damaging workpieces.

The quick release device for a panel of nail guns has a quick release mount, a pulling base, and an elastic element. The quick release mount is disposed on a body of a nail gun adjacent to a rear end of an ejecting track, and has two connecting boards and a pivotal rod connected to the two connecting boards. The pulling base is pressably connected to the quick release mount, selectively engages with a panel of the nail gun, and has an engaging hook, a pivot hole, and a pulling aim. The engaging hook is formed on and protrudes from the pulling base, and selectively engages with a limiting claw of the panel to limit a position of the panel relative to the ejecting track. The elastic element is mounted between the quick release mount and the pulling base to provide a returning force to the pulling base to the original position after rotating relative to the quick release mount.

Other objects, advantages and novel features of the invention will become more apparent from the following detailed description when taken in conjunction with the accompanying drawings.

DETAILED DESCRIPTION OF PREFERRED EMBODIMENT

Figure 1:
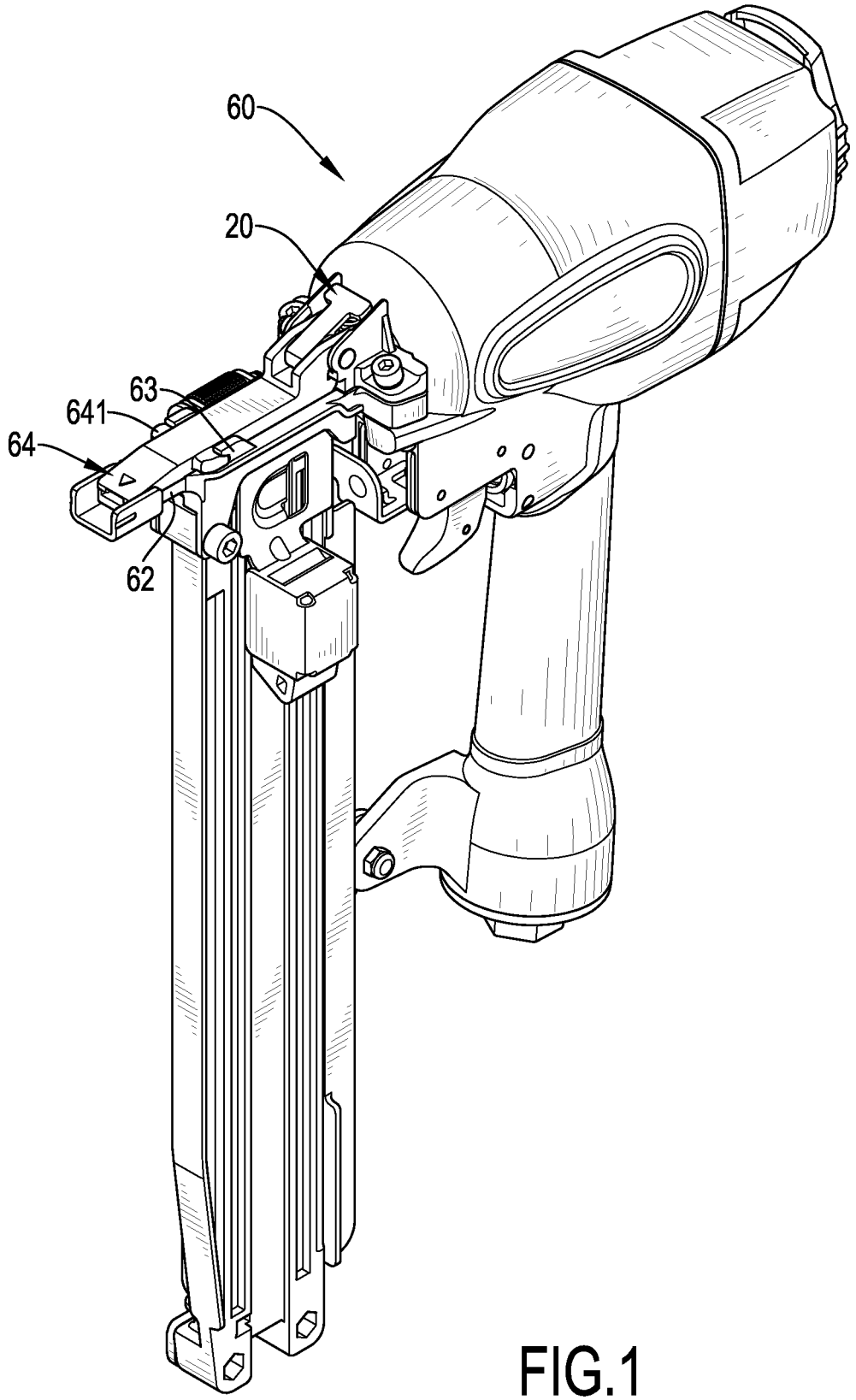
FIG. 1 is a perspective view of a quick release device for a panel of a nail gun in accordance with the present invention.
Figure 2:
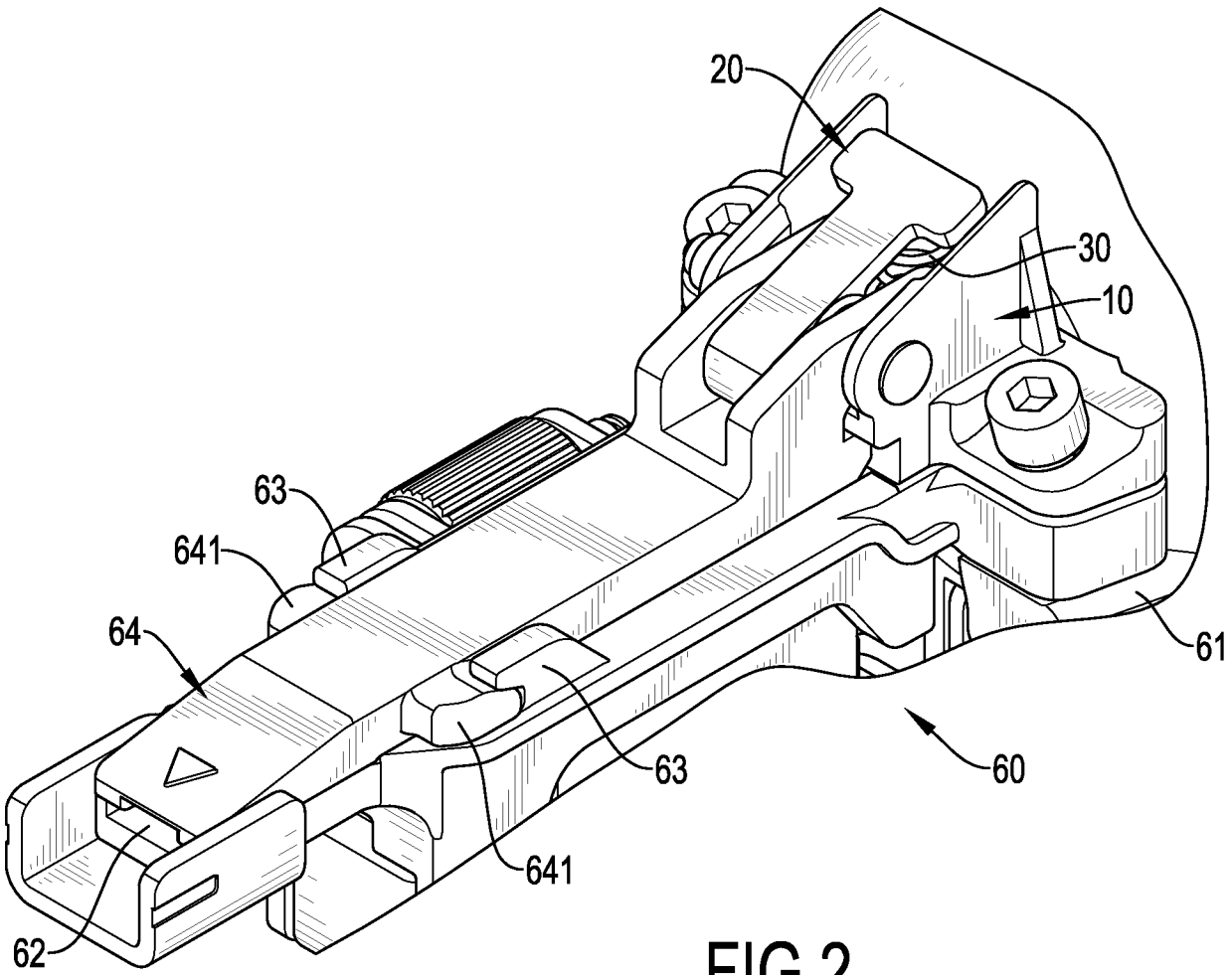
FIG. 2 is an enlarged perspective view of the quick release device in FIG. 1.

With reference to FIGS. 1 to 4, a quick release device for a panel 64 of a nail gun 60 in accordance with the present invention is disposed on a body 61 of the nail gun 60, engages with the panel 64 of the nail gun 60, and comprises a quick release mount 10, a pulling base 20, and an elastic element 30.

Furthermore, the nail gun 60 has an ejecting track 62 disposed on a front side of the body 61 and two engaging blocks 63 formed on and protruding upwardly from the body 61 beside the ejecting track 62. The panel 64 is slidably disposed on and connected to the ejecting track 62, and has a top side, two opposite sidewalls, a rear side, two abutting blocks 641, two sliding slots 642, and a limiting claw 643. The top side of the panel 64 is a smooth surface without recesses. The two abutting blocks 641 are respectively formed on and protrude from the two opposite sidewalls of the panel 64, and respectively engage with the two engaging blocks 63 of the nail gun 60 to prevent the panel 64 from moving relative to the ejecting track 62. The sliding slots 642 are elongated and are formed through the rear side of the panel 64 at a spaced interval. The limiting claw 643 is formed on and protrudes from the top side of the panel 64 between the two sliding slots 642.

Figure 3:
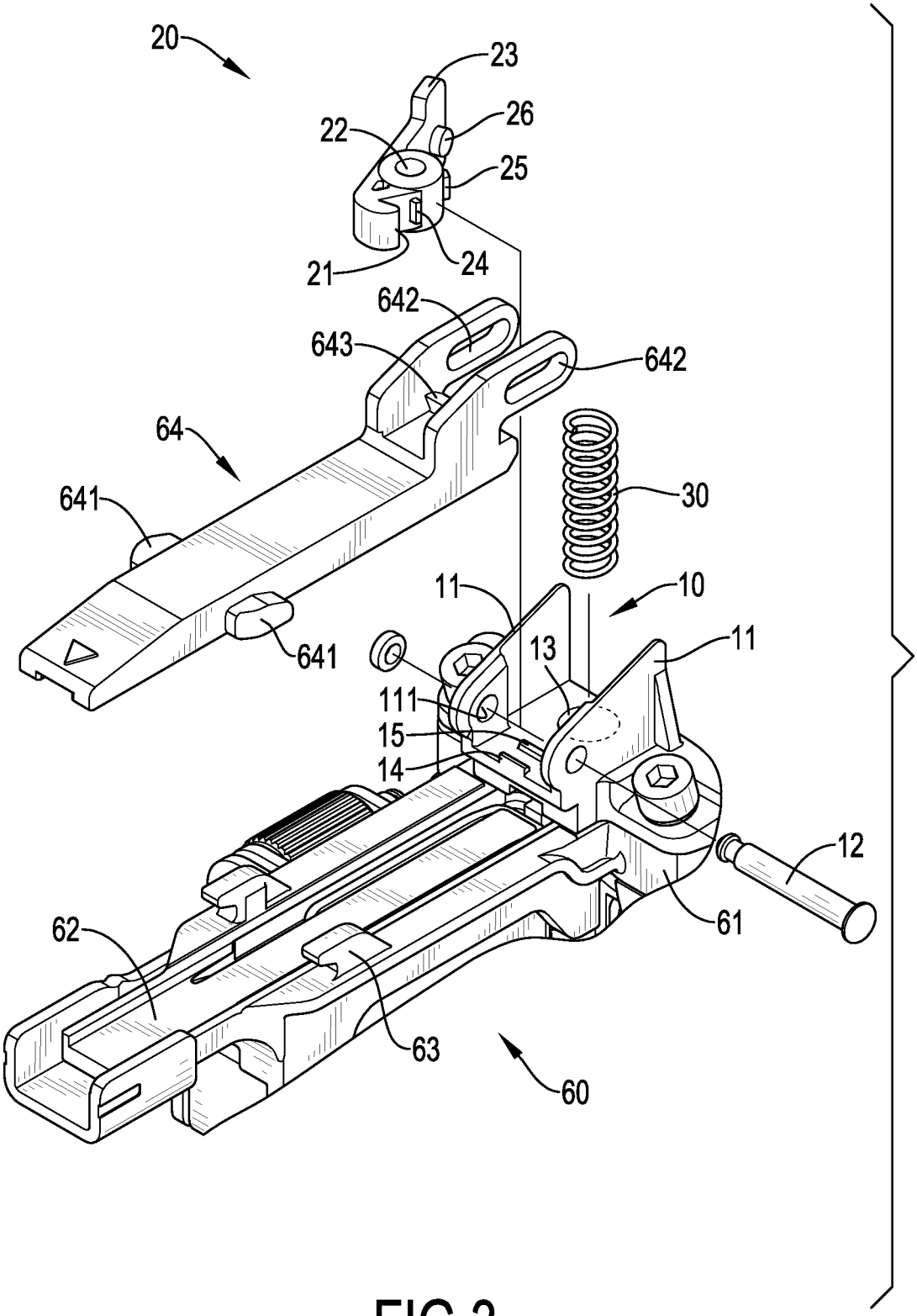
FIG. 3 is an exploded perspective view of the quick release device in FIG. 1.
Figure 4:
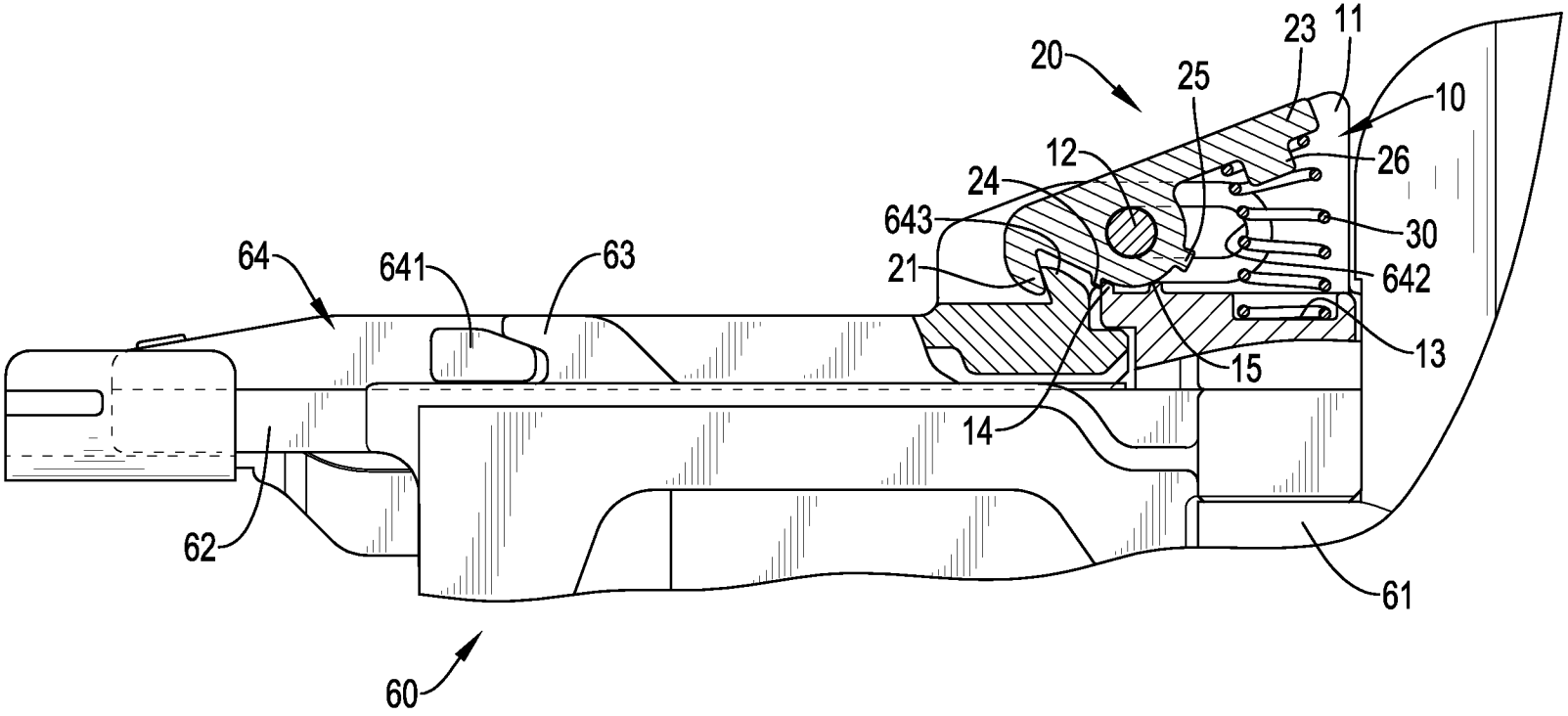
FIG. 4 is a side view in partial section of the quick release device in FIG. 1.

With reference to FIGS. 3 and 4, the quick release mount 10 is disposed on the body 61 of the nail gun 60 adjacent to a rear end of the ejecting track 62, and has a top surface, a rear end, a front end, two connecting boards 11, a pivotal rod 12, a mounting recess 13, a front positioning block 14, and a rear positioning block 15. The two connecting boards 11 are longitudinally disposed on the body 61 at a spaced interval at the rear end of the ejecting track 62. Each one of the two connecting boards 11 has a through hole 111 formed through the connecting board 11 adjacent to the front end of the quick release mount 10 and aligning with the through hole 111 of the other one of the two connecting boards 11. The pivotal rod 12 extends through the sliding slots 642 of the two panels 64 and is connected to the through holes 111 of the two connecting boards 11. The mounting recess 13 is formed in the top surface of the quick release mount 10 adjacent to the rear end of the quick release mount 10 between the two connecting boards 11. The front positioning block 14 is formed on and protrudes from the top surface of the quick release mount 10 at the front end of the quick release mount 10 between the two connecting boards 11. The rear positioning block 15 is formed on and protrudes from the top surface of the quick release mount 10 adjacent to the front positioning block 14 at a spaced interval.

With reference to FIGS. 3 and 4, the pulling base 20 is pressably connected to the quick release mount 10, selectively engages with the panel 64, and has a front end, a rear end, a bottom, an engaging hook 21, a pivot hole 22, a pulling arm 23, a front abutting rib 24, a rear abutting rib 25, and a mounting rod 26. The engaging hook 21 is formed on and protrudes from the bottom of the pulling base 20 at the front end of the pulling base 20, and selectively engages with the limiting claw 643 of the panel 64 to limit a position of the panel 64 relative to the ejecting track 62. The pivot hole 22 is formed through the pulling base 20 between the front end and the rear end of the pulling base 20, and is connected to the pivotal rod 12 to hold the pulling base 20 between the sliding slots 642 of the panel 64.

The pulling arm 23 is formed on and protrudes from the rear end of the pulling base 20, is opposite to the engaging hook 21 and is disposed between the two connecting boards 11. The front abutting rib 24 is formed on and protrudes from the bottom of the pulling base 20 adjacent to the engaging hook 21, and is selectively pressed against the front positioning block 14 of the quick release mount 10. The rear abutting rib 25 is formed on and protrudes from the bottom of the pulling base 20 at a spaced interval to the front abutting rib 24, and is selectively pressed against the rear positioning block 15 of the quick release mount 10. The mounting rod 26 is formed on and protrudes from a bottom of the pulling arm 23 and is disposed above the mounting recess 13 of the quick release mount 10.

With reference to FIGS. 3 and 4, the elastic element 30 is mounted between the quick release mount 10 and the pulling base 20 to provide a returning force to the pulling base 20 to the original position after rotating relative to the quick release mount 10. Furthermore, the elastic element 30 has two ends, one of the two ends of the elastic element 30 is mounted in the mounting recess 13 of the quick release mount 10, and the other one of the two ends of the elastic element 30 is mounted around the mounting rod 26 of the pulling base 20.

Figure 5:
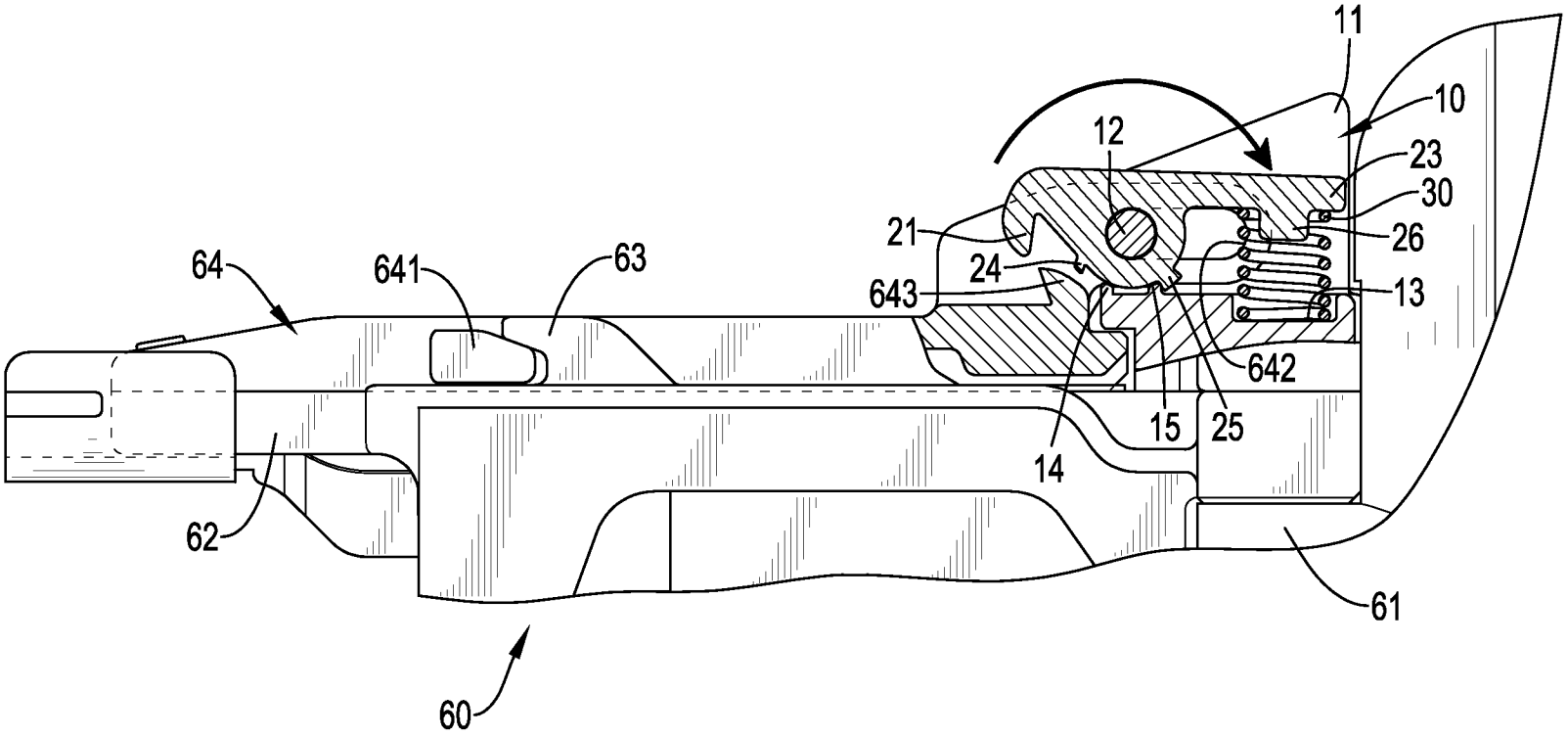
FIGS. 5 and 6 are operational side views in partial section of the quick release device in FIG. 1.
Figure 6:
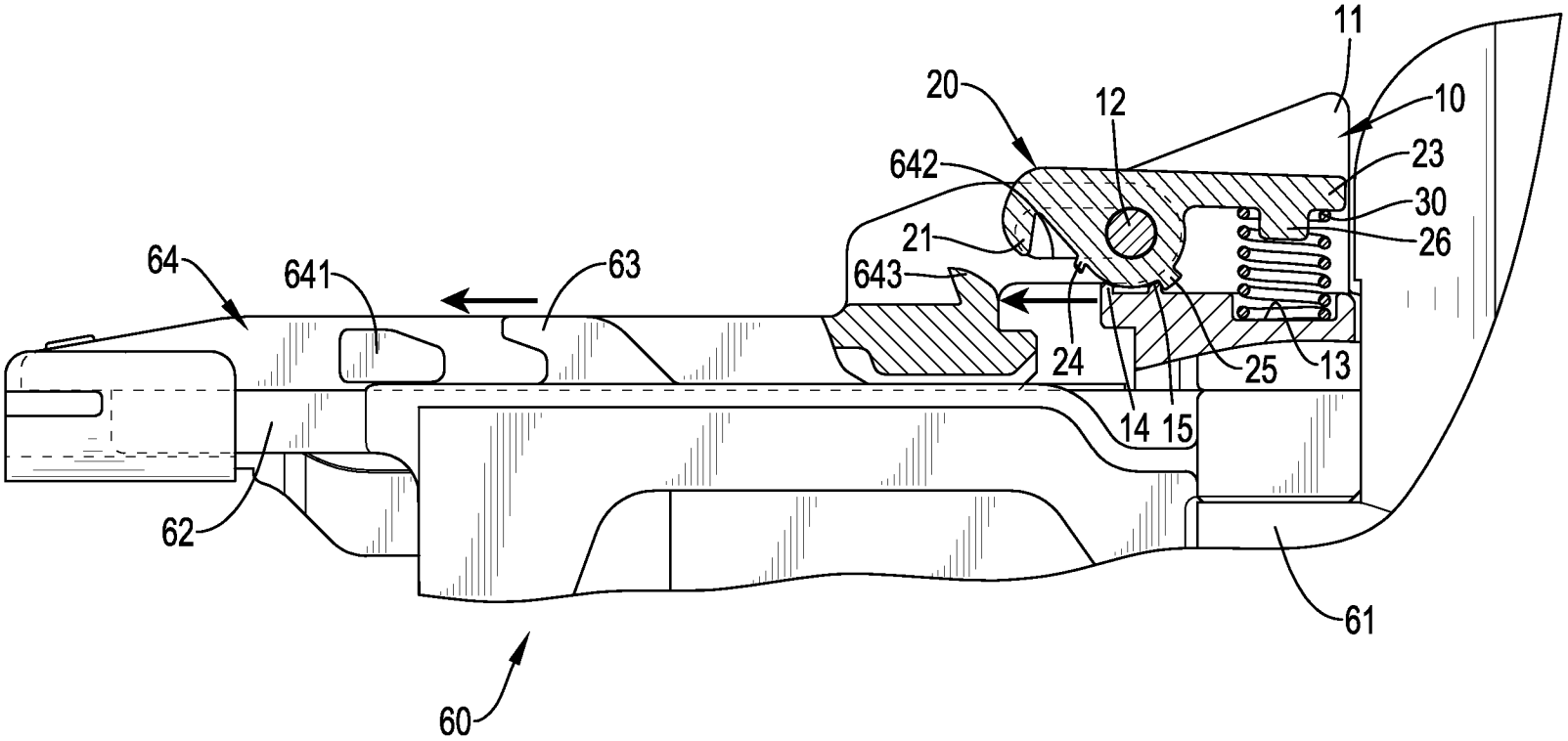
Figure 7:
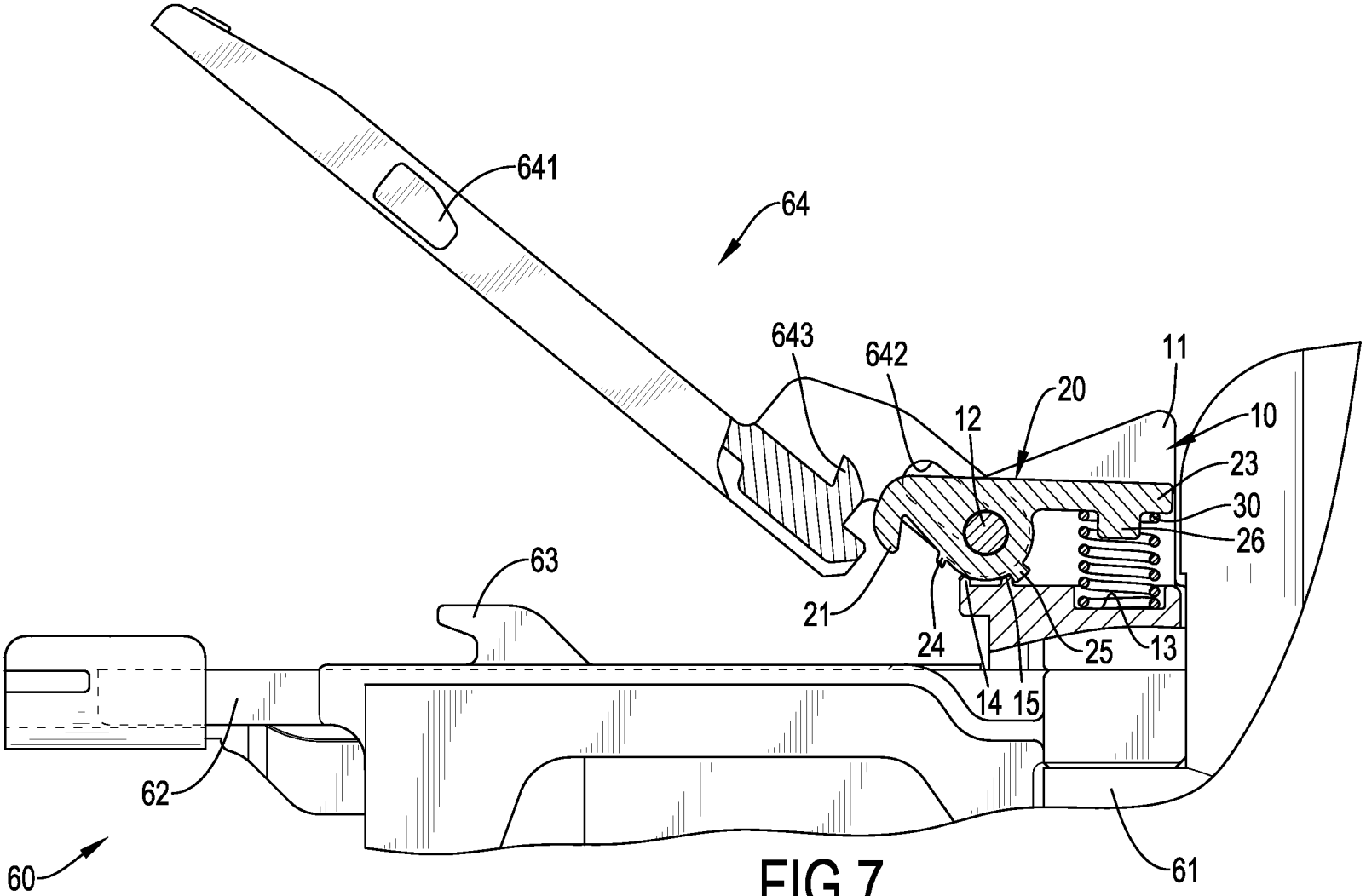
FIG. 7 is an operational side view of the quick release device in FIG. 1.
Figure 8:
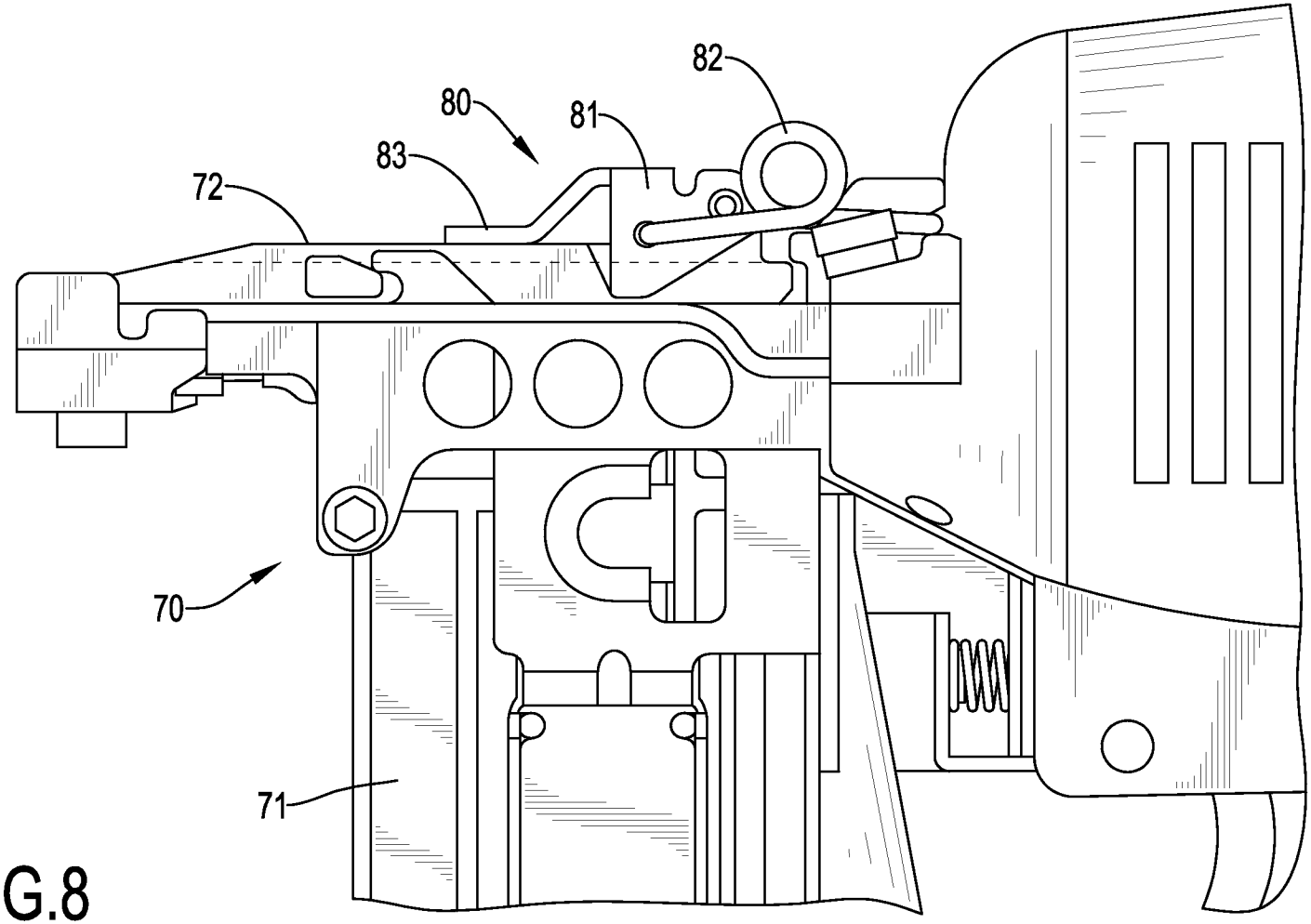
FIG.8 PRIOR ART
FIG. 8 is an enlarged side view of a quick release device for a panel of a nail gun in accordance with the prior art.
Figure 9:
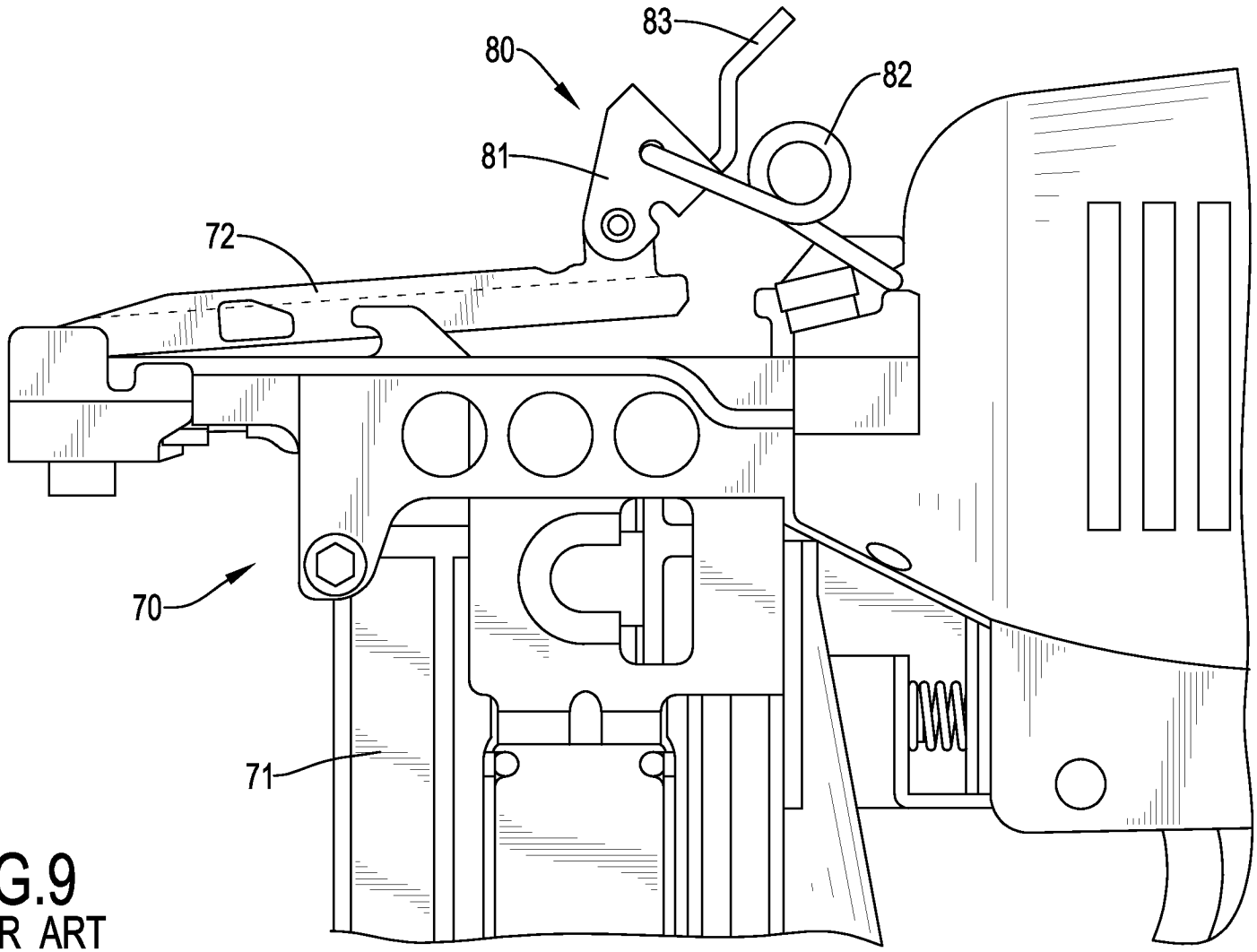
FIG.9 PRIOR ART
FIG. 9 is an operational side view of the quick release device in FIG. 8.

With reference to FIG. 5, when the quick release device for the panel 64 of the nail gun 60 is used, a user may press the pulling arm 23 of the pulling base 20 downwardly to enable the pulling base 20 to rotate relative to the quick release mount 10 with the pivotal rod 12 as a fulcrum. Then, the engaging hook 21 that is disposed on the front end of the pulling base 20 is moved upwardly to separate from the limiting claw 643 of the panel 64. The front abutting rib 24, which originally abuts against the front positioning block 14, is also separated from the front positioning block 14 by the rotation of the pulling base 20 relative to the quick release mount 10, and the rear abutting rib 25 is moved to abut against the rear positioning block 15. At the same time, with reference to FIG. 6, the panel 64 is separated from the pulling base 20 and is moved forwardly along the ejecting track 62 to enable the two abutting blocks 641 of the panel 64 to respectively separate from the two engaging blocks 63. Furthermore, the two sliding slots 642 of the panel 64 move relative to the pivotal rod 12. Then, the panel 64 can be moved and rotated relative to the ejecting track 62 as shown in FIG. 7 to adjust nails in the nail gun 60.

According to the above-mentioned features and structural relationships of the quick release device for a panel of nail guns in accordance with the present invention, the panel 64 can be separated from the pulling base 20 by pressing the pulling arm 23 downwardly. Then, the panel 64 can be moved and rotated relative to the ejecting track 62, and the nails in the nail gun 60 can be adjusted or arranged to exclude the problematic nails, and this is labor-saving in assembly and disassembly, and also can avoid injury caused by collision due to excessive force. Additionally, the elastic element 30 that is disposed between the pulling base 20 and the quick release mount 10 not only can enable the engaging hook 21 of the pulling base 20 to securely engage with the limiting claw 643 of the panel 64 to ensure the connection situation of the panel 64 and the ejecting track 62, but also can provide an effect of restoring the pulling base 20 to the original position after pressing the pulling arm 23. Furthermore, the top side of the panel 64 is a smooth surface, and this may avoid damaging the workpiece when the top side of the panel 64 abuts against the workpiece.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A quick release device for a panel of a nail gun, the nail gun having a body, an ejecting track disposed at a front side of the body, and the panel slidably connected to the ejecting track, the panel having a rear end, a top side, two sliding slots formed through the panel at the rear end of the panel at a spaced interval, and a limiting claw formed on and protruding from the top side of the panel between the two sliding slots, and the quick release device disposed on the body of the nail gun, selectively engaging with the panel, and comprising:

a quick release mount disposed on the body of the nail gun adjacent to a rear end of the ejecting track, and having a top surface;

a rear end;

a front end;

two connecting boards longitudinally disposed on the body at a spaced interval at the rear end of the ejecting track, and each one of the two connecting boards having a through hole formed through the connecting board adjacent to the front end of the quick release mount and aligning with the through hole of the other one of the two connecting boards;

a pivotal rod extending through the sliding slots of the panel and connected to the through holes of the two connecting boards;

a front positioning block formed on and protruding from the top surface of the quick release mount at the front end of the quick release mount between the two connecting boards;

a pulling base pressably connected to the quick release mount to selectively engage with the panel, and having a front end;

a rear end;

a bottom;

an engaging hook formed on and protruding from the bottom of the pulling base at the front end of the pulling base to selectively engage with the limiting claw of the panel to limit a position of the panel relative to the ejecting track;

a pivot hole formed through the pulling base between the front end and the rear end of the pulling base, and connected to the pivotal rod to hold the pulling base between the sliding slots of the panel; and a pulling arm formed on and protruding from the rear end of the pulling base, being opposite to the engaging hook, and disposed between the two connecting boards; and a front abutting rib formed on and protruding from the bottom of the pulling base adjacent to the engaging hook, and selectively pressed against the front positioning block of the quick release mount; and an elastic element mounted between the quick release mount and the pulling base to provide a returning force to the pulling base to the original position after rotating relative to the quick release mount.

2. The quick release device as claimed in claim 1, wherein the quick release mount has a rear positioning block formed on and protruding from the top surface of the quick release mount adjacent to the front positioning block at a spaced interval; and the pulling base has a rear abutting rib formed on and protruding from the bottom of the pulling base at a spaced interval to the front abutting rib, and selectively pressed against the rear positioning block of the quick release mount.

3. The quick release device as claimed in claim 2, wherein the quick release mount has a mounting recess formed in the top surface of the quick release mount adjacent to the rear end of the quick release mount between the two connecting boards;

the pulling base has a mounting rod formed on and protruding from a bottom of the pulling arm and disposed above the mounting recess of the quick release mount; and the elastic element has two ends, one of the two ends of the elastic element is mounted in the mounting recess of the quick release mount, and the other one of the two ends of the elastic element is mounted around the mounting rod of the pulling base.

4. The quick release device as claimed in claim 3, wherein the top side of the panel is a smooth surface.

5. The quick release device as claimed in claim 2, wherein the top side of the panel is a smooth surface.

6. The quick release device as claimed in claim 1, wherein the quick release mount has a mounting recess formed in the top surface of the quick release mount adjacent to the rear end of the quick release mount between the two connecting boards;

the pulling base has a mounting rod formed on and protruding from a bottom of the pulling arm and disposed above the mounting recess of the quick release mount; and the elastic element has two ends, one of the two ends of the elastic element is mounted in the mounting recess of the quick release mount, and the other one of the two ends of the elastic element is mounted around the mounting rod of the pulling base.

7. The quick release device as claimed in claim 6, wherein the top side of the panel is a smooth surface.

8. The quick release device as claimed in claim 1, wherein the top side of the panel is a smooth surface.

* * * * *